US005847653A

United States Patent [19]

Flegel

[11] Patent Number: 5,847,653

[45] Date of Patent: Dec. 8, 1998

[54] ELECTRIC PANEL HEAT ALARM WITH A THERMALLY NON-CONDUCTIVE MOUNTING ARRANGEMENT

[75] Inventor: David D. Flegel, Racine, Wis.

[73] Assignee: Reliance Time Controls, Inc., Racine, Wis.

[21] Appl. No.: 1,881

[22] Filed: Dec. 31, 1997

[51] Int. Cl.[6] ..... G08B 17/06

[52] U.S. Cl. ..... 340/584; 340/594; 340/693

[58] Field of Search ..... 340/594, 584, 340/693

[56] References Cited

U.S. PATENT DOCUMENTS 5,461,367 10/1995 Altavela et al. ..... 340/584

*Primary Examiner*—Glen R. Swann, III

*Attorney, Agent, or Firm*—Andrus, Sceales, Starke & Sawall

[57] ABSTRACT

An heat alarm for an electric panel cabinet mounts a heat sensor within the enclosed area defined by the electric panel cabinet to monitor the temperature within the cabinet and sound an alarm if the temperature in the cabinet exceeds an upper temperature limit. The heat alarm includes a mounting arrangement positioned between the enclosure of the heat alarm and the electric panel cabinet such that the heat alarm can be mounted to the electric panel cabinet and the heat sensor positioned within the cabinet. The mounting arrangement of the heat alarm is formed of a thermally non-conductive material such that the enclosure containing the heat alarm is thermally isolated form the electric panel cabinet such that the enclosure of the heat alarm does not affect the temperature within the cabinet.

14 Claims, 2 Drawing Sheets

ELECTRIC PANEL HEAT ALARM WITH A THERMALLY NON-CONDUCTIVE MOUNTING ARRANGEMENT

BACKGROUND OF THE INVENTION

The present invention relates to a heat alarm for an electric panel cabinet. More specifically, the present invention relates to a heat alarm that includes a thermally non-conductive mounting arrangement that thermally isolates the heat alarm from the electric panel cabinet.

Electric panel cabinets typically house the main electric service panels or subpanels for the electric supply to a residential or commercial building. Electric panel cabinets typically contain many components that may overheat and start fires, such as feeder conductors, branch circuit conductors, circuit breakers, fuses, and bus bars. The overheating of one of these electrical components within an electric panel cabinet can be caused by many types of malfunctions, such as loose or corroded connections, power overloads, or other malfunctions in the components themselves. When one of these electric components malfunctions, the large amount of voltage and current flowing through the components causes heat buildup within the cabinet and ultimately can ignite a fire within the cabinet, which then may spread to nearby building structural components and create a fire hazard.

Although smoke alarms are required to be in every residential or commercial building by the majority of local building codes, these smoke alarms often do not provide adequate protection against fires started in the electric panel cabinets. Specifically, smoke alarms are often not located near the electric panel cabinet, since the electric panel cabinet is typically located in a remote area of the building away from the normally occupied areas. Even if a smoke alarm is located near the electric panel cabinet, the smoke alarm typically reacts only after a fire has started and a sufficient amount of smoke has been produced. In an electric panel cabinet, an overheat condition may exist for hours or even days before smoke is present to trip a smoke alarm. Thus, an opportunity exists to activate an alarm before a fire starts by sensing an overheat condition occurring within the electric panel cabinet. Additionally, since many smoke alarms in commercial buildings are connected to the building's electrical system, a fire started in the electric panel cabinet can cause a loss of electric power, which then disables the smoke alarm.

Altavela U.S. Pat. No. 5,461,367 teaches an electric panel heat alarm that responds to an overheat condition within an electric panel cabinet. The alarm disclosed in the '367 patent positions a heat sensor within the enclosed area defined by the cabinet and uses a battery power supply to activate an audible alarm when the temperature within the electric panel cabinet exceeds an upper temperature limit. While the alarm disclosed in the '367 patent operates sufficiently to indicate an overheat condition in the electric panel cabinet, the alarm of the '367 patent suffers from several drawbacks. Specifically, the alarm of the '367 patent includes a metallic conduit nipple extending between the alarm enclosure and the electric panel cabinet. Additionally, the alarm is secured to the electric panel cabinet by a pair of metallic lock nuts that interact with the conduit nipple. It has been found that the static air conditions within the interior of the electric panel cabinet conduct heat poorly and, since the conduit nipple and the lock nuts are formed of a metallic material having a high thermal conductivity, heat within the interior of the electric panel cabinet can be transferred out of the cabinet through the conduit nipple and the lock nuts. In this manner, the metallic mounting components and enclosure of the alarm act to wick heat out of the cabinet through the nipple and lock nuts, thereby resulting in a condition in which the temperature near the heat sensor is not elevated in accordance with an actual increase in temperature within the cabinet interior. Thus, the alarm of the '367 patent may not operate until the temperature within the electric panel cabinet is greater than the predetermined upper temperature limit which activates the alarm.

It is therefore an object of the present invention to provide a heat alarm that responds to an overheat condition in an electric panel cabinet by activating an audible alarm. It is a further object of the invention to provide a heat alarm having a thermally non-conductive mounting arrangement such that the heat alarm does not affect the temperature within the cabinet. Yet another object of the invention is to provide a heat alarm in which the temperature near the heat sensor is elevated immediately upon an increase in the temperature within the cabinet interior. It is a further object of the invention to provide such a mounting arrangement which is easily and inexpensively manufactured and which allows the heat alarm to be securely attached to the electric panel cabinet without affecting the temperature within the cabinet.

BRIEF SUMMARY OF THE INVENTION

The present invention is a heat alarm that responds to an overheat condition within an enclosed area defined by an electric panel cabinet. The present invention includes a thermally non-conductive mounting arrangement that attaches the heat alarm enclosure to the electric panel cabinet.

The heat alarm of the invention includes a metallic enclosure that contains the operating components for the heat alarm. The metallic enclosure includes an access opening formed in the bottom wall. An externally threaded conduit nipple passes through the access opening and into the electric panel cabinet through a knockout opening formed in the cabinet. The nipple defines an internal passageway through which a heat sensor can pass such that the heat sensor is disposed within the interior of the electric panel cabinet.

The mounting arrangement further includes a pair of lock nuts that engage the externally threaded nipple on opposite sides of the top wall of the electric panel cabinet. By tightening the lock nuts along the nipple, the heat alarm can be securely attached to the electric panel cabinet. The mounting arrangement, including the nipple and the pair of lock nuts, is constructed of a thermally non-conductive material such that heat within the interior of the electric panel cabinet, or heat conducted by the cabinet walls, cannot be transferred to the metallic enclosure of the heat alarm through the mounting arrangement. Preferably, the mounting arrangement is constructed of a thermoplastic material that has a relatively low thermal conductivity when compared to the metallic material forming the electric panel cabinet and the enclosure of the heat alarm. In this manner, the mounting arrangement thermally insulates the enclosure of the heat alarm from the electric panel cabinet such that the enclosure of the heat alarm does not act to transfer heat out of the electric panel cabinet.

Other features and advantages of the invention may be apparent to those skilled in the art upon inspecting the following drawings and description thereof.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
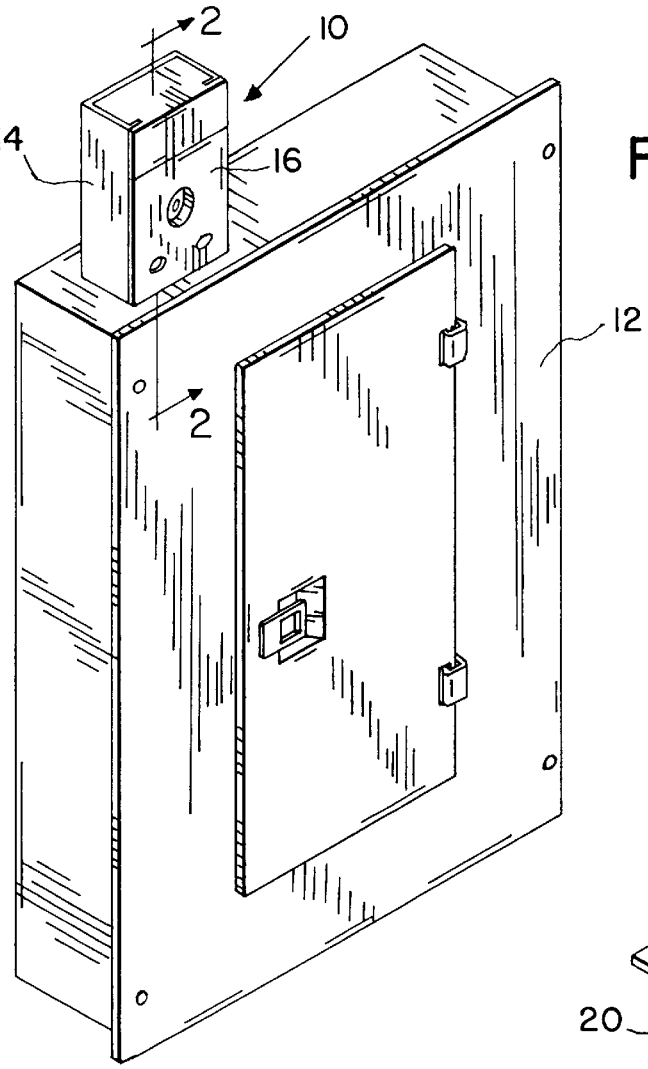
FIG. 1 is a general isometric view of the heat alarm of the present invention as mounted to an electric panel cabinet.

FIG. 1 shows a heat alarm 10 of the present invention as mounted to a conventional electric panel cabinet 12. The electric panel cabinet 12 typically encloses a variety of components used in routing electric power through a building, such as circuit breakers, fuses, and bus bars. Although the heat alarm 10 is shown as mounted to the top of the electric panel cabinet 12, the heat alarm 10 can be mounted to other areas of the cabinet 12, such as either one of the sidewalls or the front face.

Figure 4:
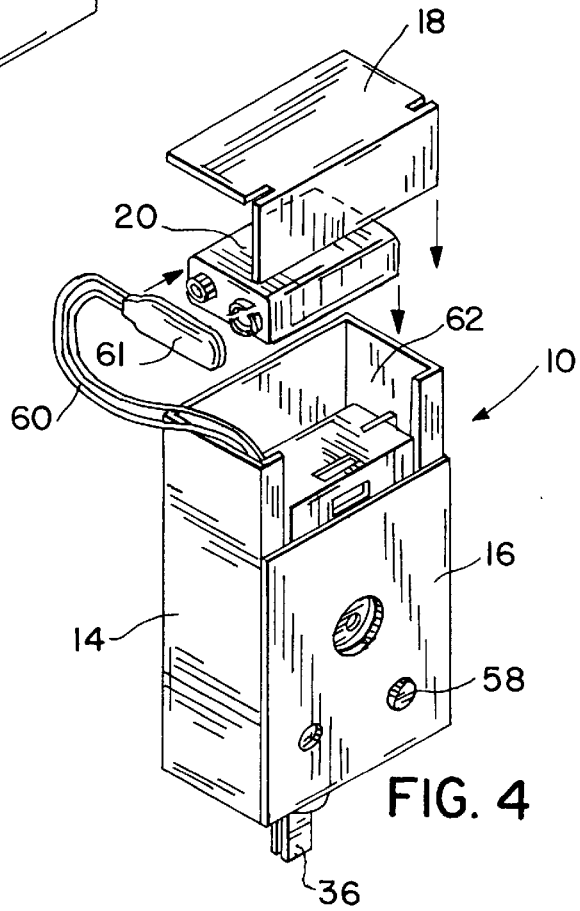
FIG. 4 is an exploded isometric view of the heat alarm of the present invention.

The heat alarm 10 generally includes a box-like enclosure 14 having a front face 16. As shown in FIG. 4, the enclosure 14 includes a removable battery cover 18 that provides access to a battery 20 mounted within an upper compartment defined by the interior of the enclosure 14.

Figure 2:
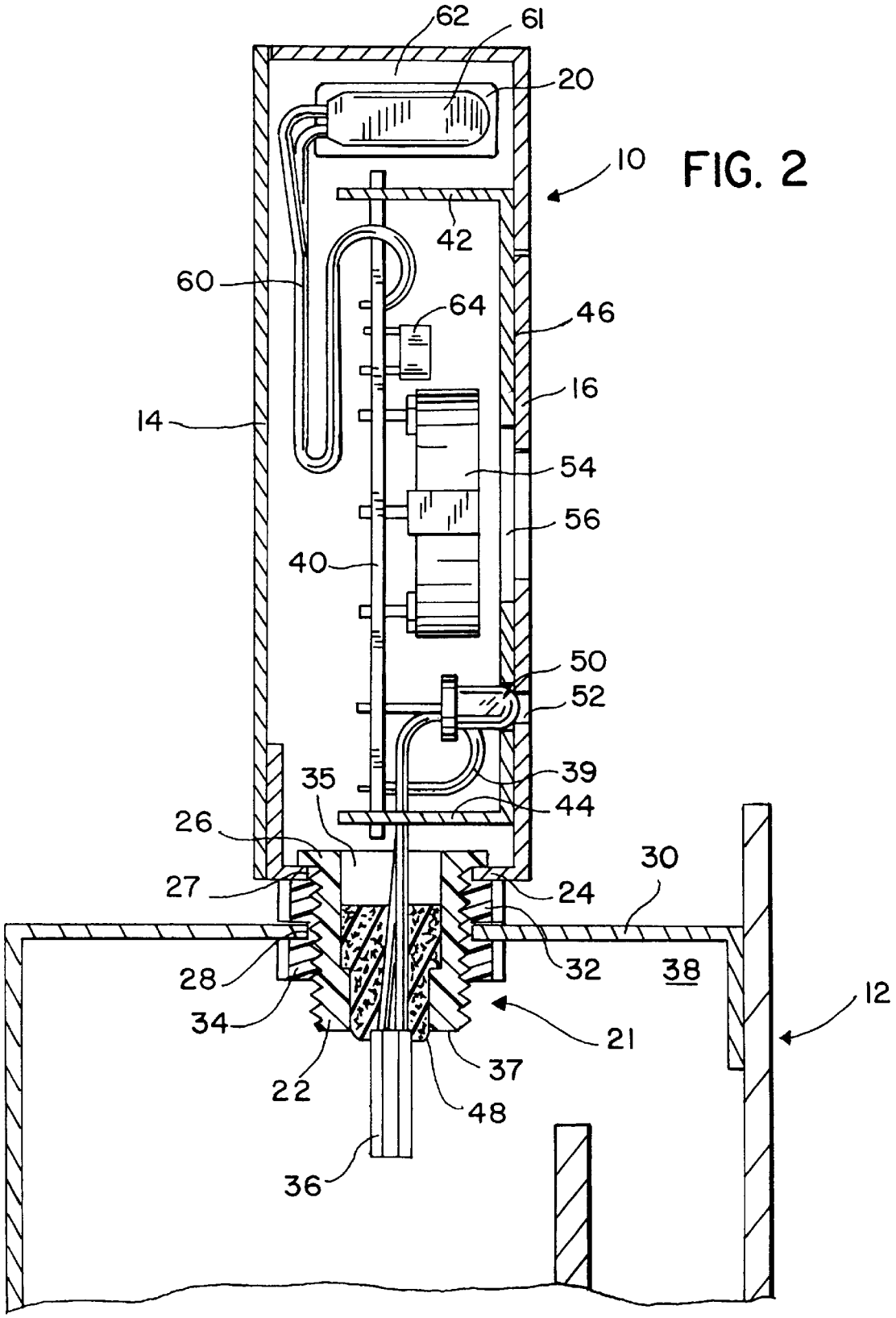
FIG. 2 is a sectional view taken along line 2—2 of FIG. 1 showing the internal components of the heat alarm of the present invention.

Referring now to FIG. 2, the heat alarm 10 includes a mounting arrangement 21 for attaching the heat alarm 10 to the electric panel cabinet 12. In the preferred embodiment of the invention, the mounting arrangement 21 includes an externally threaded rigid conduit nipple 22 extending through a bottom wall 24 of the enclosure 14. The nipple 22 includes a top flange 26 that prevents the nipple 22 from completely passing through an access opening 27 in the bottom wall 24. The heat alarm 10 is attached to the electric panel cabinet 12 by passing the threaded nipple 22 through a knockout opening 28 in a top wall 30 of the electric panel cabinet 12.

The mounting arrangement 21 further includes an internally threaded upper lock nut 32 threadedly engaged with the nipple 22 between the bottom wall 24 of the enclosure 14 and the top wall 30 of the electric panel cabinet 12. The upper lock nut 32 has a diameter greater than the diameter of the knockout opening 28 such that the upper lock nut 28 allows the enclosure 14 to sit slightly above the top wall 30 of the electric panel cabinet 12. The mounting arrangement 21 also includes an internally threaded lower lock nut 34 that threadedly engages the threaded nipple 22 on the inside of the top wall 30 of the electric panel cabinet 12. The enclosure 14 is secured to the electric panel cabinet 12 by tightening the lower lock nut 34 along the threaded nipple 22 until the top wall 30 is securely pressed between the upper lock nut 32 and the lower lock nut 34. In the preferred embodiment of the invention, the top flange 26 is securely attached to the bottom wall 24 of the enclosure 14, such that the nipple 22 is prevented from rotating within the enclosure 14.

As can best be seen in FIG. 2, a bimetallic, single pole, closed-on-temperature rise heat sensor 36 passes through an internal passageway 35 formed in the nipple 22 and is disposed just below a lower edge 37 of the nipple 22. In the preferred embodiment of the invention, the heat sensor 36 includes a bimetal switch that closes when the temperature within the electric panel 12 reach a predetermined value. In the preferred embodiment, the heat sensor 36 is selected such that the bimetal switch closes when the temperature within the electric panel cabinet 12 reaches approximately 135° F., although it is understood that any other threshold temperature may be specified. Thus, when the heat alarm 10 is positioned as shown in FIG. 2, the heat sensor 36 is disposed within an enclosed area 38 defined by the electric panel cabinet 12. The heat sensor 36 is connected by a pair of wires 39 to a circuit board 40. The circuit board 40 is securely retained within the enclosure 14 by a pair of support tabs 42 and 44 included on a support bracket 46. The support bracket 46 is securely mounted to the front face 16 of the enclosure 14 such that the support bracket 46 provides a secure point of attachment for the circuit board 40 and the components mounted thereto.

The heat sensor 36 is isolated from the nipple 22 by a foam insulating member 48 positioned within the internal passageway 35, such that the material forming the nipple 22 does not affect the operation of the heat sensor 36. By connecting the heat alarm 10 to the electric panel cabinet 12 via the nipple 22 extending through the knockout opening 28 in the top wall 30 of cabinet 12, the heat sensor 36 is disposed just inside of the electric panel cabinet 12. In this manner, the heat sensor 36 is positioned such that it can detect the temperature within the enclosed area 38 defined by cabinet 12 so that the heat alarm 10 can warn of an unsafe overheat condition.

As can be seen in FIG. 2, various other components are mounted to the circuit board 40 within the enclosure 14. Specifically, a visual indicator 50 is connected to the circuit board 40. The visual indicator 50 is aligned with an opening 52 in the front face 16 of the enclosure 14 such that the visual indicator 50 is visible from the exterior of the enclosure 14. In the preferred embodiment of the invention, the visual indicator 50 is a red LED.

An audible alarm 54 is also connected to the circuit board 40. The audible alarm 54 is aligned with a sound opening 56 extending through both the front face 16 and the support bracket 46. The sound opening 56 allows sound generated by the audible alarm 54 to freely pass through the enclosure 14 such that the sound can be clearly heard.

Figure 3:
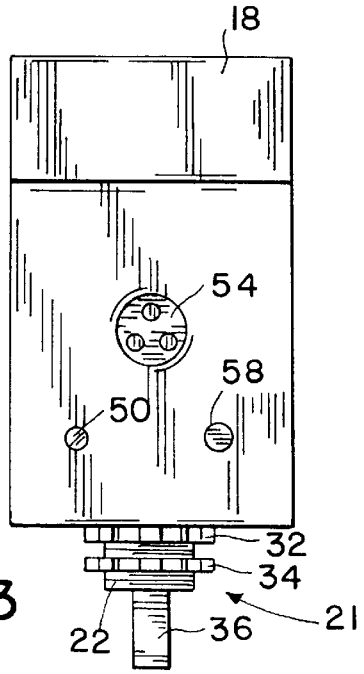
FIG. 3 is a elevation view of the heat alarm of the present invention.

Although not shown in FIG. 2, a test/reset button 58 (FIGS. 3, 4) is connected to the circuit board 40. The test/reset button 58 is accessible through the front face 16 of the enclosure 14, as shown in FIG. 4. In the preferred embodiment of the invention, the test/reset button 58 is a conventional spring-loaded push-button switch that allows the home/business owner to manually test the operation of the audible alarm 54.

As can best be seen in FIG. 2, the battery 20 is connected by a pair of leads 60 and a conventional battery harness 61 to the circuit board 40. The battery 20 is operatively connected via the circuit board 40 to provide the required power to operate the audible alarm 54 and the visual indicator 50. The battery 20 is contained within a battery chamber 62 defined by the support tab 42 and the battery cover 18, as best shown in FIG. 4. In this manner, the battery 20 can be replaced by simply removing the battery cover 18 and detaching the battery 20 from the battery harness 61 in a conventional manner.

In the preferred embodiment of the invention, a microprocessor 64 is connected to the circuit board 40 as is shown in FIG. 2. The microprocessor 64 is coupled to the battery 20, the heat sensor 36, the visual indicator 50, the audible alarm 54, and the test/reset button 58 through the pre-printed circuit board 40. In this manner, the microprocessor 64 can control the operation of the entire heat alarm 10. In the preferred embodiment of the invention, the microprocessor 64 is model number PIC16C54 as sold by Motorola. The microprocessor 64 was specifically selected based on its low power consumption in an attempt to extend the life of the battery 20. Although this microprocessor 64 was selected for the above-noted reason, other microprocessors could be substituted while operating within the scope of the invention. Additionally, the heat alarm 10 could be constructed without the microprocessor 64 while still operating within the scope of the invention. In a heat alarm 10 without a microprocessor, the closure of the switch in the heat sensor 36 completes a connection between the battery 20 and the audible alarm 54 to activate the audible alarm 54.

Referring now to FIG. 2, the detailed construction of the mounting arrangement 21 will be discussed. In prior heat alarms, such as shown in the Altavela U.S. Pat. No. 5,461,367, the mounting arrangement 21, including the nipple 22 and lock nuts 32 and 34, is constructed from a durable metallic material such that the mounting arrangement 21 can securely attach the heat alarm to the electric panel cabinet 12. Typically, both the enclosure 14 and the electric panel cabinet 12 are each also constructed from a metallic material, such as stainless steel. The metallic material forming both the enclosure 14 and the electric panel cabinet 12 has a relatively high thermal conductivity, such that heat is transferred relatively easily through the material forming the enclosure 14 and the electric panel cabinet 12. Since the mounting arrangement of prior heat alarms is also typically constructed from a metallic material having a relatively high thermal conductivity, heat within the enclosed space 38 can be transferred out of the enclosed area 38 through the mounting arrangement and dispersed by convection from the enclosure 14. Since heat is being transferred out of the enclosed area 38, the temperature near the heat sensor 36 does not accurately reflect an actual temperature rise within the enclosed area 38, such that the heat alarm senses a temperature lower than the actual temperature within the enclosed area 38. Thus, the prior art heat alarms are not activated until the actual temperature within the enclosed area 38 is well above the predetermined upper temperature limit.

In the present invention, the entire mounting arrangement 21, including the nipple 22, the upper lock nut 32 and the lower lock nut 34 is formed from a material having a low thermal conductivity as compared to the cabinet 12 and the enclosure 14, such that little to no heat from within the enclosed area 38 is transferred through the mounting arrangement 21 to the enclosure 14. In this manner, the mounting arrangement 21 of the present invention acts as an insulator between the metallic enclosure 14 and the metallic electric panel cabinet 12. In the preferred embodiment of the invention, the mounting arrangement 21, including the nipple 22 and lock nuts 32 and 34 is formed from a thermoplastic material having a very low thermal conductivity relative to the enclosure 14 and the electric panel cabinet 12. For example, the mounting arrangement 21 preferably is formed of a thermoplastic material such as nylon or the like. Additionally, the material forming the mounting arrangement 21 must be able to withstand the elevated temperatures that may be present in the electric panel cabinet 12 without deforming.

Although the nipple 22 and the lock nuts 32 and 34 are preferably formed from a thermoplastic material, it is understood that various other materials, preferably non-metallic materials, could be used to form the nipple 22 and the lock nuts 32 and 34 as long as the thermal conductivity of these components is very low, such that the mounting arrangement 21 acts as an insulator to prevent the transfer of heat out of the enclosed area 38. By using the mounting arrangement 21 of the present invention, the heat alarm 10 is able to more accurately respond to elevated temperatures conducted by the static air within the enclosed area 38 and the walls of cabinet 12, to thereby sound the audible alarm 54 when these temperatures exceed the upper temperature limit.

Although the present invention has been described as including a mounting arrangement 21 having low thermal conductivity as compared to the cabinet 12 and the enclosure 14, it is also contemplated by the inventor that the enclosure 14 could be formed from a material also having a low thermal conductivity. For example, the enclosure 14 could be formed from a plastic or durable nylon material rather than a metallic material such as steel. If the enclosure 14 were constructed of such material having a low thermal conductivity, the enclosure 14 would further prevent heat from being transferred out of the enclosed area 38 defined by the electric panel cabinet 12. In a heat alarm having an enclosure 14 formed of a material having a low thermal conductivity, the mounting arrangement 21 could be formed from a material having either a high thermal conductivity, such as metal, or a low thermal conductivity as previously discussed. Since the enclosure 14 would be formed from a material having a low thermal conductivity, heat would not be transferred to the outside air through the enclosure 14.

It is recognized that various equivalents, alternatives and modifications to the invention as described are possible. Such equivalents, alternatives and modifications should be considered to fall within the scope of the following claims.

I claim:

1. In a heat alarm for an electrical panel cabinet including an enclosure mountable to the cabinet, a power supply contained within the enclosure, a heat sensor adapted to extend from the enclosure into the cabinet for indicating when the temperature in the cabinet exceeds an upper temperature limit, and an alarm device that is activated when the temperature in the cabinet exceeds the upper temperature limit, the improvement comprising:

a mounting arrangement for securing the enclosure to the electric panel cabinet, the mounting arrangement being formed of a generally thermally non-conductive material such that the enclosure is generally thermally isolated from the electric panel cabinet by the mounting arrangement.

2. The improvement of claim 1 further comprising a power supply contained within the enclosure, the power supply being coupled to the alarm device.

3. The improvement of claim 1 wherein the mounting arrangement includes an externally threaded nipple extending from the enclosure and into the electric panel cabinet.

4. The improvement of claim 3 wherein the mounting arrangement further includes a pair of lock nuts that engage the nipple on each side of the electric panel cabinet to attach the heat alarm to the electric panel cabinet, the pair of lock nuts being formed of a generally thermally non-conductive material.

5. The improvement of claim 1 wherein the mounting arrangement is formed from a thermoplastic material.

6. The improvement of claim 1 wherein the mounting arrangement includes an internal passageway that extends between the cabinet and the enclosure and through which the heat sensor extends.

7. The improvement of claim 6, further comprising a resilient thermally non-conductive mounting member disposed within the internal passageway for securing the heat sensor relative to the mounting arrangement.

8. An heat alarm for an electric panel cabinet, the heat alarm comprising:

an enclosure defining an open interior, the enclosure being mountable to the electric panel cabinet;

a nipple defining an internal passageway, the nipple extending from the enclosure and into the electric panel cabinet, the nipple being formed of a material having a relatively low heat conductivity;

a heat sensor extending through the internal passageway defined by the nipple, the heat sensor extending into the enclosed area defined by the electric panel cabinet, the heat sensor indicating the temperature in the enclosed area defined by the electric panel cabinet; and an alarm device coupled to the heat sensor, the alarm device being activated when the temperature in the electric panel cabinet exceeds an upper temperature limit.

9. The heat alarm of claim 8 wherein the nipple is externally threaded and further comprising a pair of lock nuts for engaging the externally threaded nipple on each side of the electric panel cabinet to securely attach the heat alarm to the electric panel cabinet.

10. The heat alarm of claim 9 wherein the pair of lock nuts are formed of a material having a relatively low heat conductivity.

11. The heat alarm of claim 10 wherein the enclosure is formed from a metallic material, such that the thermally non-conductive nipple and lock nuts thermally isolate the enclosure from the electric panel cabinet.

12. The heat alarm of claim 8 wherein the nipple extends through a knockout portion of the electric panel cabinet.

13. The heat alarm of claim 8 wherein the enclosure is formed from a material having a relatively low heat conductivity.

14. A method of mounting a heat sensor to a heat alarm for use with an electric panel cabinet, comprising the steps of:

providing a heat alarm mounting arrangement formed of a material having a relatively low heat conductivity; and securing the mounting arrangement to the heat alarm and securing the heat sensor to the mounting arrangement;

wherein the mounting arrangement is adapted to be mounted to the electric panel cabinet for securing the heat alarm thereto such that the heat sensor is exposed to the interior of the electric panel cabinet.

* * * * *